United States Patent [19]

Engel

[11] 4,237,774

[45] Dec. 9, 1980

[54] DISPLACEMENT CONTROL VALVING FOR A RADIAL PISTON DEVICE

[75] Inventor: William K. Engel, Peoria, Ill.

[73] Assignee: Caterpillar Tractor Co., Peoria, Ill.

[21] Appl. No.: 94,257

[22] Filed: Jul. 16, 1979

[51] Int. Cl.[3] ..... F01B 13/06; F04B 1/04

[52] U.S. Cl. ..... 91/490; 91/497; 417/217

[58] Field of Search ..... 417/217, 221; 91/490, 91/492, 497

[56] References Cited

U.S. PATENT DOCUMENTS

| | | | |
|---|---|---|---|
| 2,006,880 | 7/1935 | Benedek | 91/492 |
| 2,429,368 | 10/1947 | Quiroz | 91/497 |
| 3,274,946 | 9/1966 | Simmons | 91/490 |
| 3,530,768 | 9/1970 | Engel | 91/497 |
| 3,744,379 | 7/1973 | Freeman | 91/497 |
| 3,828,400 | 8/1974 | Mason et al. | 91/497 |
| 3,899,957 | 8/1975 | Carlson et al. | 91/490 |
| 4,195,553 | 4/1980 | Alie | 417/221 |

*Primary Examiner*—William L. Freeh

*Attorney, Agent, or Firm*—John W. Grant

[57] ABSTRACT

A radial piston device such as a radial piston motor (10) has a rotor assembly (34) rotatably positioned within a cylindrical race (43) which is movable to a first displacement position by a first piston (52) and a second displacement position by a second piston (53). A pintle (26) extends into a bore (36) of a rotor (33) of the rotor assembly (34) and has first and second ports (27,28) for delivering fluid to and from the rotor (33). In order to reduce the size of the radial piston device and to minimize the number of external lines, a control valve (66) is positioned within a bore (59) of the pintle (26) and selectively controls fluid flow from one of the first and second ports (27,28) to the first and second pistons (52,53) for shifting the cylindrical race (43) between the first and second positions.

18 Claims, 5 Drawing Figures

DISPLACEMENT CONTROL VALVING FOR A RADIAL PISTON DEVICE

DESCRIPTION

1. Technical Field

This invention relates to a radial piston device and more particularly to the placement of a displacement control valving integrally within a pintle of the radial piston device.

2. Background Art

Many vehicles have a hydrostatic or hydraulic drive for propelling the vehicle. For example, some track type vehicles have a hydraulic module, i.e. hydraulic motor, displacement control valving, reduction gearing, and parking brake, mounted within each of the track assemblies. Preferably the hydraulic drive module should fit within the width of the track shoe and within the diameter of the track chain drive sprocket. Heretofore the displacement control valving of such hydraulic modules was mounted externally of the motor thereby increasing the overall size of the individual hydraulic drive module. Because of the physical space requirements of the heretofore available hydraulic drive modules, hydraulic drives are presently excluded from some vehicles simply because they won't fit within the rather confined space allocated for the drive train in the track assembly. Further, such hydraulic drive modules have several external lines which are vulnerable to battering which could cause them to leak.

DISCLOSURE OF INVENTION

The present invention solved the problem of providing a compact hydraulic drive module by including the displacement control valving integrally within the pintle of the radial piston device and picking up fluid for controlling the displacement of the radial piston device internally from within the radial piston device.

In one aspect of the present invention a radial piston device has a housing, a cylindrical race eccentrically positioned within the housing and movable between a first position at which a first displacement setting of the device is established and a second position at which a second displacement setting of the device is established, first and second means for moving the cylindrical race to said first and second positions, respectively, a rotor assembly rotatably positioned within the cylindrical race, a pintle positioned within a bore of a rotor of the rotor assembly for relative rotation therebetween and having first and second fluid control ports for delivering fluid to and from said rotor, and displacement control valve means for selectively controlling fluid flow from a source of pressurized fluid to and from said first means, and wherein the valve means is positioned within the pintle and the source of pressurized fluid is one of the first and second ports.

BEST MODE FOR CARRYING OUT THE INVENTION

Figure 1:
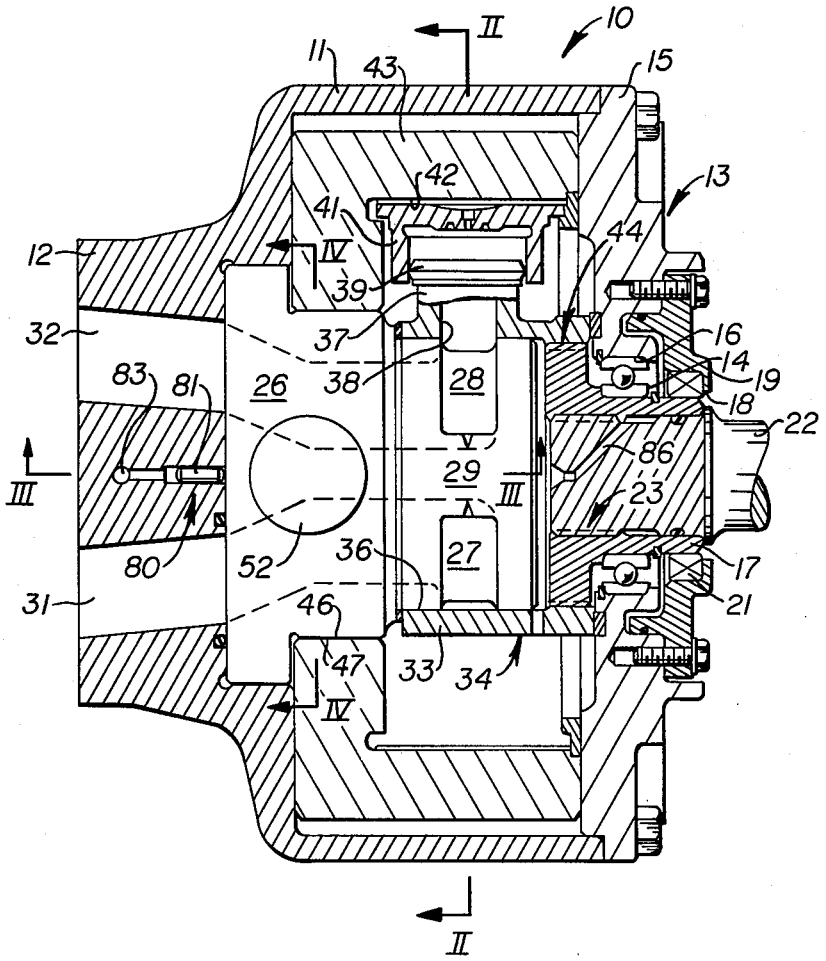
FIG. 1 is a cross sectional view of an embodiment of the present invention.
Figure 2:
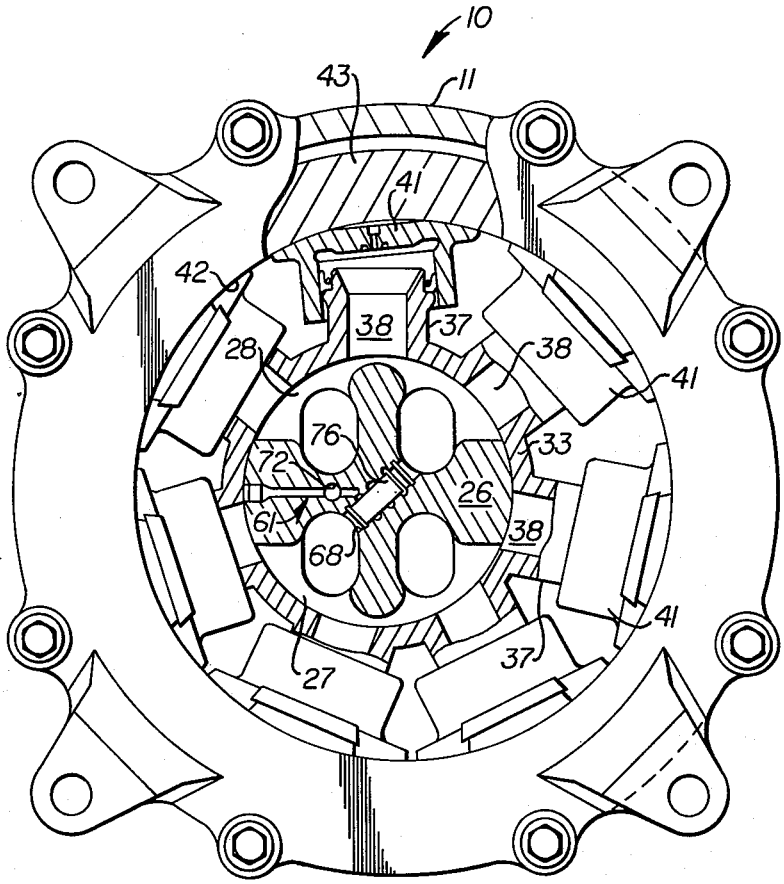
FIG. 2 is a partial sectional view taken generally along line II—II of FIG. 1.

Referring to the FIGS. 1 and 2 of the drawings, a radial piston device is generally indicated by the reference numeral 10 and it is to be understood that device 10 can operate as either a pump or motor without any change to the basic structure. In the description following, device 10 is described principally as a reversible motor for a hydraulic drive system. The device 10 includes a housing 11 which is closed at one end by an integral end portion 12 and at the opposite end by a cover assembly 13. A bearing 14 is seated in a bore 16 in end cover 15 and receives a hollow shaft 17 which extends through an opening 18 in a seal retainer 19 connected to cover 15. A seal 21 carried by seal retainer 19 seals against the outer surface of hollow shaft 17. An output shaft 22 extends into shaft 17 and is drivingly connected thereto by a spline connection 23.

A pintle 26 is connected to end portion 12 and has first and second fluid control ports 27, 28 in a stem 29. The ports 27, 28 communicate with a pair of passages 31, 32 respectively.

A rotor 33 of a rotor assembly 34 has a bore 36 therein. Stem 29 of pintle 26 extends into bore 36 and supports the rotor assembly for rotation thereabout. Rotor 33 includes a plurality of radially extending spokes 37 each of which has a radial passage 38 extending therethrough from bore 36 to a distal end of the spoke. Each distal end has a seal 39 mounted thereon with the seal slidably positioned within a cylinder 41 so that seal 39 and the distal end act as a piston within the cylinder. The closed end portion of the cylinder forms a slipper shoe bearing which slidably engages a bore 42 formed in a cylindrical race 43. The rotor is drivingly connected to shaft 17 by a spline connection 44.

Figure 4:
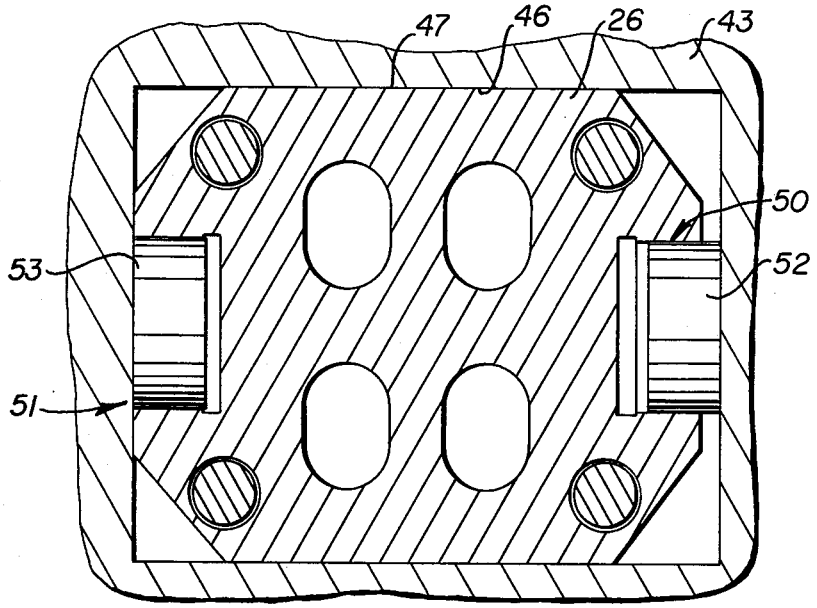
FIG. 4 is a sectional view taken along line IV—IV of FIG. 1.

The cylindrical race 43 is eccentrically positioned within housing 11 and has a substantially rectangular opening 46 formed therein as more clearly shown in FIG. 4. The rectangular opening is slidably received by a substantially rectangular shoulder 47 of pintle 26 in a manner such that the cylindrical race is retained against rotation but can be moved transversely between first and second positions as will be described hereinafter in greater detail. The first position of the cylindrical race establishes a first displacement setting of the motor and hence a first speed range while the second position of the cylindrical race establishes a second displacement setting of the motor and hence a second speed range.

First and second means 50,51 (FIGS. 3 and 4) are provided for moving the race 43 to the first and second positions respectively. Each of the first and second means can be, for example, pistons 52,53 slidably positioned within the chambers 54,56 recessed in opposite sides of rectangular shoulder 47 of pintle 26 with the ends of the pistons abutting the opposing face of rectangular opening 46 in the cylindrical race 43.

A displacement control valve means 58 is provided for delivering fluid from a source of pressurized fluid to and from first and second means 50,51. The valve means is positioned within the pintle 26 and the source of fluid is one of the first and second ports 27,28. Displacement control valve means 58 includes a bore 59 in the pintle 26 and a passage means 61 (FIG. 5) for communicating bore 59 with the first and second ports 27,28. A pair of passages 62,63 connect the bore 59 with chambers 54,56 of first and second means 50,51. A passageway 64 connects bore 59 with the housing interior which is connected to a reservoir or tank in the usual manner. A valve spool 66 is slidably positioned within bore 59 and has a reduced end portion 66*a*, a pair of annular grooves 66*b* and 66*c*, and passage 67 communicating annular groove 66*c* with reduced end portion 66*a*. The valve spool 66 is movable between a first position at which the passage means 61 is in fluid communication via annular groove 66*b*, with passage 62 and hence chamber 54 of first means 50 and a second position at which the passage 62 and hence first means 50 is vented to drain through passageway 64. At the second position of valve spool 66 the passage means 61 is in fluid communication with passage 63 and hence chamber 56 of second means 51 via annular groove 66*b*. At the first position of the valve spool 66 passage 63 and hence chamber 56 of second means 51 is vented to drain through passage 67 and passageway 64.

Figure 5:
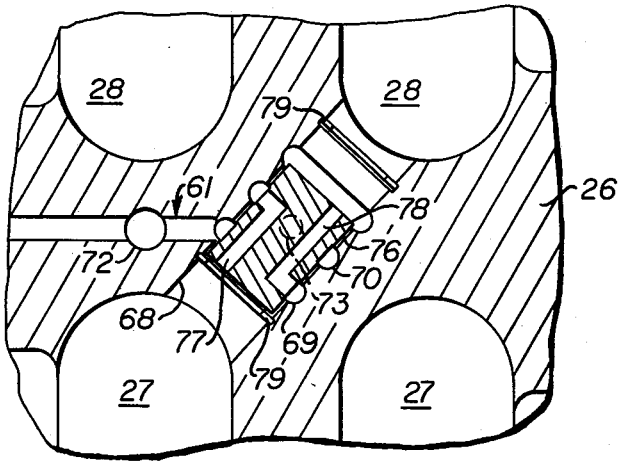
FIG. 5 is an enlarged fragmentary sectional view of the central portion of FIG. 2.

Referring to FIGS. 4 and 5, passage means 61 includes another bore 68 in pintle 26 and interconnected to the first and second ports 27,28. A pair of annuli 69,70 are provided in bore 68. Annulus 69 is connected to a passageway 72 which in turn is connected to bore 59. A passageway 73 connects annulus 70 with a chamber 74 in bore 59 at one end of valve spool 66. A shuttle valve 76 is slidably positioned within bore 68 and has a first passage 77 in fluid communication with port 27 and a second passage 78 in fluid communication with port 28. The shuttle valve 76 is retained within bore 68 by a pair of retainer rings 79. The shuttle valve 76 is movable between first and second positions in response to a pressure differential in the fluid within ports 27 and 28. At the first position of shuttle valve 76 passage 77 is in fluid communication with annulus 70 and hence passage 73 while passage 78 is in fluid communication with annulus 69 and hence passageway 72. At the second position of shuttle valve 76 passage 78 is in fluid communication with annulus 70 and hence passage 73 while annulus 69 and hence passageway 72 is in fluid communication with port 27.

A piston means 80 (FIG. 3) is provided for moving the valve spool 66 to the second position. The piston means can be, for example, a piston 81 slidably positioned within a bore 82 in the end portion 12 for abutment with one end of valve spool 66. A port 83 is connected to bore 82 for delivering fluid to the bore from a separate source of fluid (not shown).

An orifice 84 and a passage 85 in the end of stem 29 of pintle 26 directs fluid from annulus 70 through a passage 86 (FIG. 1) to spline connection 23 for lubrication thereof.

INDUSTRIAL APPLICABILITY

Figure 3:
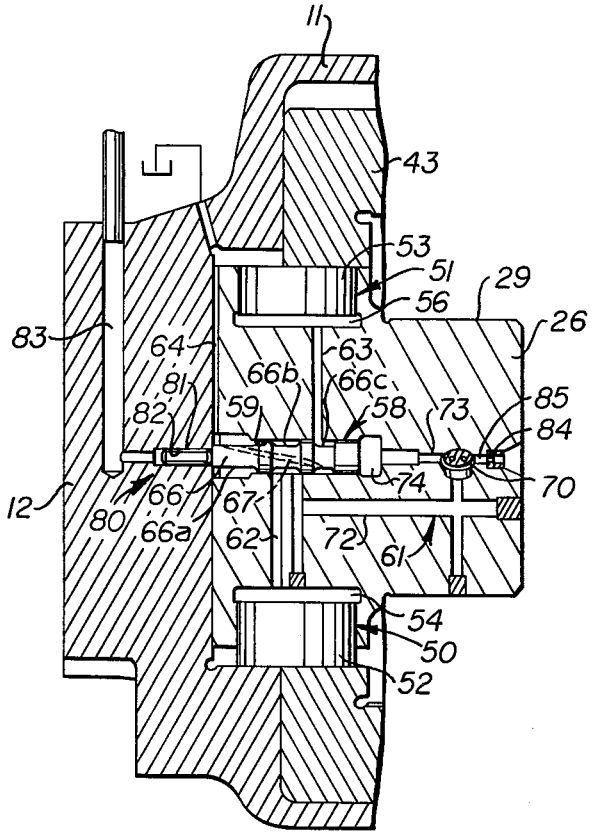
FIG. 3 is a partial sectional view taken along line III—III of FIG. 1.

In operation with pressurized fluid being directed to the radial piston device 10 through passage 32 and port 28, rotor 33 and hence output shaft 22 will rotate clockwise. Also shuttle valve 76 will be in the first position as shown in FIG. 5 so that pressurized fluid from port 28 will be directed through second passage 78 of shuttle valve 76, annulus 69 and passageway 72. Although port 27 will be considered an outlet port it will be pressurized to some extent due to back pressure in the system to which the radial piston device 10 is connected. Thus at the first position of shuttle valve 76 fluid under low pressure from port 27 will be communicated through passage 77 of shuttle valve 76, annulus 70, passage 73 and into chamber 74 where it biases valve spool 66 to the left or first position as shown in FIG. 3. This low pressure fluid is also available to lubricate the spline connection 23 through passage 85, orifice 84 and passage 86. Alternatively a spring can be positioned within chamber 74 to bias valve spool 66 to the left.

With valve spool 66 in the first position the high pressure fluid from passageway 72 is communicated through passage 62 and into chamber 54. The pressurized fluid in chamber 54 maintains the cylindrical race 43 in the position shown in FIGS. 2 and 4, which position commonly referred to as a low speed high torque range. The actual speed of the radial piston device within a particular speed range will be controlled by the fluid flow directed through passage 32 from the source of fluid.

In order to shift the cylindrical race 43 to the high speed range or to the left as viewed in FIGS. 2 and 4 pressurized fluid from a source of fluid is selectively directed through port 83 and into bore 82 thereby causing piston 81 to move valve spool 66 to the right to its second position against the bias of the relatively low fluid pressure in chamber 74. At the second position of valve spool 66 pressurized fluid from passageway 72 is communicated through passage 63 into chamber 56 while passage 62 and hence chamber 54 is vented to tank through passageway 64. This results in piston 53 moving outwardly, moving cylindrical race 43 to the left as viewed in FIG. 4. A reducing the displacement of the radial piston device. As is well known in the art reducing the displacement of a hydraulic motor without any change in the fluid flow thereto causes the motor to run at a faster speed.

To reverse the direction of rotation of output shaft 22, pressurized fluid is directed through passage 31 and port 27 while port 28 becomes the outlet port. The pressurized fluid in port 27 also shifts the shuttle valve 76 to the second position whereby pressurized fluid is communicated from port 27 to passageway 72 where it becomes available for being directed to either chamber 54 or 56 depending upon the position of valve spool 66. Likewise, the low pressure fluid in port 28 is communicated through passage 78 in shuttle valve 76, annulus 70, passage 73 and into chamber 74 where it biases valve spool 66 to the first position.

In view of the foregoing it is readily apparent that the structure of the present invention provides an improved displacement control valving for a radial piston device which is integrally positioned within a component of the device. By placing the valving within the pintle, the overall size of the drive module is reduced and the number of external lines connected thereto is reduced.

Other aspects, objects and advantages of this invention can be obtained from a study of the drawings, the disclosure and the appended claims.

I claim:

1. In a radial piston device (10) having a housing (11), a cylindrical race (43) eccentrically positioned within the housing (11) and movable between a first position at which a first displacement setting of the device is established and a second position at which a second displacement setting of the device is established, first and second means (50,51) for moving the cylindrical race (43) to said first and second positions respectively, a rotor assembly (34) having a rotor (33), a pintle (26) positioned within a bore (36) of the rotor (33) for relative rotation therebetween and having first and second fluid control ports (27,28) for delivering fluid to and from said rotor (33), and valve means (58) for selectively controlling fluid flow from a source of pressurized fluid to and from said first means (50), the improvement comprising:

wherein said valve means (58) is positioned within said pintle (26) and said source of pressurized fluid is one of said first and second fluid control ports (27,28).

2. The radial piston device (10) of claim 1 wherein said valve means (58) includes a bore (57) in said pintle, passage means (61) for connecting said bore (59) with one of said first and second ports (27,28), and a valve spool (66) slidably positioned within the bore (59) and movable between a first position at which the passage means (61) is in fluid communication with the first means (50) and a second position at which the first means (50) is vented to drain.

3. The radial piston device of claim 2 wherein at said second position of the valve spool (66) the passage means (61) is in fluid communication with the second means (51).

4. The radial piston device (10) of claim 3 wherein at said first position of the valve spool (66) the second means (51) is in fluid communication with the other of the first and second ports (27,28).

5. The radial piston device (10) of claim 4 wherein the first means (50) includes a first chamber (54) in the pintle (26) and a piston (52) within the first chamber (54) and being in engagement with the cylindrical race (43), and the second means (51) includes a second chamber (56) in the pintle (26) substantially diametrically opposite to the first chamber (54) and a second piston (53) slidably positioned within the second chamber (56) and being in engagement with the cylindrical race (43), the first and second chambers (54,56) being connected to bore (59).

6. The radial piston device (10) of claim 2 wherein the passage means (61) includes a bore (68) in the pintle (26) and connected to the first and second ports (27,28), a shuttle valve 76 is slidably positioned within the bore (68) and movable between a first position at which the second port (28) is in fluid communication with the first bore (59) in the pintle (26) and a second position at which the first port (27) is in communication with the first bore (59) in the pintle (26), the shuttle valve (76) being moved to the first and second positions in response to the fluid pressure in said one of the first and second ports (27,28) being higher than the fluid pressure in the other of the first and second ports (27,28).

7. The radial piston device of claim 6 wherein at the second position of the valve spool (66) the passage means (61) is in fluid communication with the second means (51).

8. The radial piston device of claim 6 wherein the shuttle valve (76) has a first passage (77) in communication with the first port (27) and a second passage (78) in communication with the second port (28), wherein at the first position of the shuttle valve (76) said fluid communication between the second port (28) and the first bore (59) in the pintle (26) is established through the second passage (78) in the shuttle valve (76).

9. The radial piston device of claim 8 wherein the first means (50) includes a first chamber (54) in the pintle (26) and a first piston (52) slidably positioned within the first chamber (54) and being in engagement with the cylindrical race (43), and the second means (51) includes a second chamber (56) in the pintle (26) substantially diametrically opposite to the first chamber (54) and a second piston (53) slidably positioned within the second chamber (56) and being in engagement with the cylindrical race (43), the first and second chambers (54,56) being connected to the first bore.

10. The radial piston device (10) of claim 8 including means for biasing the valve spool (66) to one of the first and second positions, and means (80) for selectively moving the valve spool (66) to the other of said first and second positions against the bias of the biasing means.

11. The radial piston device (10) of claim 10 wherein the biasing means includes a chamber (74) positioned at one end of the valve spool (66) and connected to the other of the first and second ports (27,28) through one of the first and second passages (77,78) in the shuttle valve (76).

12. The radial piston device of claim 11 wherein the moving means includes a piston (81) positioned at the other end of the valve spool (66).

13. In a radial piston device (10) comprising:

a housing (11);

a cylindrical race 43 eccentrically positioned within the housing (11) and movable between a first position at which a first displacement setting of the device (10) is established and a second position at which a second displacement setting of the device (10) is established;

first and second means (50,51) for moving the cylindrical race (43) to the first and second positions respectively;

a rotor assembly (34) rotatably positioned within the cylindrical race (43) and having a rotor (33), said rotor having a central bore (59) therein;

a pintle (26) connected to the housing (11) and extending into the bore (36) of the rotor (33), the pintle (26) having first and second fluid control ports (27,28) for delivering fluid to and from the rotor assembly (34);

a bore (59) in the pintle (26);

passage means (61) in the pintle (26) connecting the bore (59) of the pintle (26) with one of the first and second ports (27,28); and a valve spool (66) positioned within the bore (59) of the pintle (26) and movable between a first position at which the passage means (61) is in fluid communication with the first means (50) and a second position at which the first means (50) is vented.

14. The radial piston device (10) of claim 13 wherein the passage means (61) includes a bore (68) in the pintle (26) and connected to the first and second ports (27,28), a shuttle valve (76) slidably positioned within the bore (68) and movable between a first position at which the second port (28) is in fluid communication with the first bore (59) in the pintle (26) and a second position at which the first port (27) is in communication with the first bore (59) in the pintle (26), the shuttle valve (76) being moved to the first and second positions in response to the fluid pressure in said one of the first and second ports (27,28) being higher than the fluid pressure in the other of the first and second ports (27,28).

15. The radial piston device (10) of claim 14 wherein the shuttle valve (76) has a first passage (77) in communication with the first port (27) and a second passage (78) in communication with the second port (28), and wherein at the first position of the shuttle valve (76), said fluid communication between the second port (28) and the first bore (59) in the pintle (26) is established through the second passage (78) in the shuttle valve (76).

16. The radial piston device (10) of claim 15 including means for biasing the valve spool (66) to of the first and second positions, and means (80) for selectively moving the valve spool (66) to the other of said first and second positions against the bias of the biasing means.

17. The radial piston device (10) of claim 16 wherein the biasing means includes a chamber (74) positioned at one end of the valve spool (66) and connected to the other of the first and second ports (27,28) through one of the first and second passages (77,78) in the shuttle valve (76).

18. The radial piston device of claim 17 wherein the moving means includes a piston (81) positioned at the other end of the valve spool (66).

* * * * *